United States Patent [19]

Thebert

[11] 4,400,135

[45] Aug. 23, 1983

[54] VANE ACTUATION SYSTEM

[75] Inventor: Glenn W. Thebert, Carmel, Ind.

[73] Assignee: General Motors Corporation, Detroit, Mich.

[21] Appl. No.: 251,148

[22] Filed: Apr. 6, 1981

[51] Int. Cl.[3] ..... F01D 17/16

[52] U.S. Cl. ..... 415/134; 415/149 R; 415/162

[58] Field of Search ..... 415/136, 149 R, 160, 415/162

[56] References Cited

U.S. PATENT DOCUMENTS

| | | | |
|---|---|---|---|
| 2,817,475 | 12/1957 | Moody | 415/149 |
| 2,858,062 | 10/1958 | Allen | 415/149 |
| 2,999,630 | 9/1961 | Warren et al. | 415/149 |
| 3,356,288 | 12/1967 | Corsmeier | 415/149 |
| 3,458,118 | 7/1969 | Burge et al. | 415/160 |
| 3,487,992 | 1/1970 | Pineda | 415/149 |
| 3,841,788 | 10/1974 | Sljusarev et al. | 415/160 |
| 3,873,230 | 3/1975 | Norris et al. | 415/149 |

FOREIGN PATENT DOCUMENTS

| | | | |
|---|---|---|---|
| 44619 | 5/1961 | Poland | 415/149 |

*Primary Examiner*—Philip R. Coe
*Assistant Examiner*—T. W. Epting
*Attorney, Agent, or Firm*—Saul Schwartz

[57] ABSTRACT

An improved vane actuation system for a gas turbine engine having adjustable stator vanes in stages between which the engine casing exhibits relative axial and radial thermal growth, the improved system including a pair of platforms on the casing forming therewith three bar link arrangements which automatically compensate for radial and axial thermal growth, rollers on each platform supporting vane actuation rings in centered relationship on the axis of the engine, connectors between the rings and the vane arms which locate the vanes but which permit radial expansion of the arms to accommodate radial thermal growth, a pair of bell cranks on each platform operated remotely and simultaneously, and links between each bell crank and corresponding ones of the rings operative to rotate the rings and, in combination with the rollers, to foreclose translation of the rings in their respective planes.

3 Claims, 4 Drawing Figures

VANE ACTUATION SYSTEM

BACKGROUND OF THE INVENTION

This invention relates generally to gas turbine engines having adjustable stator vane assemblies and in particular to an improved actuation system for effecting vane adjustment.

Gas turbine engines employing axial compressor structures typically embody longitudinally spaced high and low pressure compressor sections each having a plurality of stator vane stages wherein means are provided for varying the positions of the stator vanes in selected stages relative to the engine casing. In one common arrangement, each stator vane in a stage has a shaft rotatably supported on and projecting out of the engine casing. Each shaft, in turn, has an actuator arm attached to it and the ends of all of the arms for the particular stage of vanes engage an actuator ring disposed around the engine. Driving means are provided between a fixed support, such as the engine casing, and the ring to effect rotation of the ring and consequent pivotal movement of each actuator arm for simultaneously adjusting the positions of the vanes. When it is desired to adjust more than one stage of vanes there is usually provided a common actuating device, such as a push rod, which functions to simultaneously drive each of the actuator rings. Once adjustment is achieved, the driving means and the actuator rings function to rigidly maintain the individual stator vanes in their adjusted positions.

Where the adjustable stages are located in longitudinally spaced compressor sections, significant operating temperature differences are usually encountered which cause the engine casing and other components to exhibit different thermal growth patterns at the longitudinally spaced stator vane stages. If means are not otherwise provided, the different thermal growth patterns can change the adjusted positions of the vanes, thus effecting engine performance, or can impose undesired loads on bearings and bushings, making adjustment more difficult. A vane actuation system according to this invention represents an improvement over heretofore known systems for effecting simultaneous adjustment of stator vanes disposed in different temperature environments.

SUMMARY OF THE INVENTION

The primary feature, then, of this invention is that it provides an improved stator vane actuation system for a gas turbine engine. Another feature of this invention is that it provides an improved vane actuation system capable of effecting simultaneous adjustment of multiple vane stages in different operating temperature environments while maintaining the adjusted positions of the vanes without unacceptable loading on vane and adjuster supports. A further feature of this invention resides in the provision in the improved actuation system of platforms disposed across the plural vane stages which platforms form three-bar linkage systems adapted to automatically adjust for radial and axial thermal growth of the engine casing, each platform supporting driving means connected to the actuator rings for the vane stages to be adjusted. A still further feature of this invention resides in the provision in the improved actuation system of drive means between the actuator rings and the platforms which permit radial and axial thermal growth of the casing without altering the adjusted positions of the vanes and without imposing undesirable loads on the connections between the vanes, the casing, and the actuator rings. Yet another feature of this invention resides in the provision in the improved actuation system of simplified support means on the platforms which support the actuator rings and maintain the rings centered around the engine casing.

These and other features of this invention will be readily apparent from the following specification and from the drawings wherein.

Figure 1:
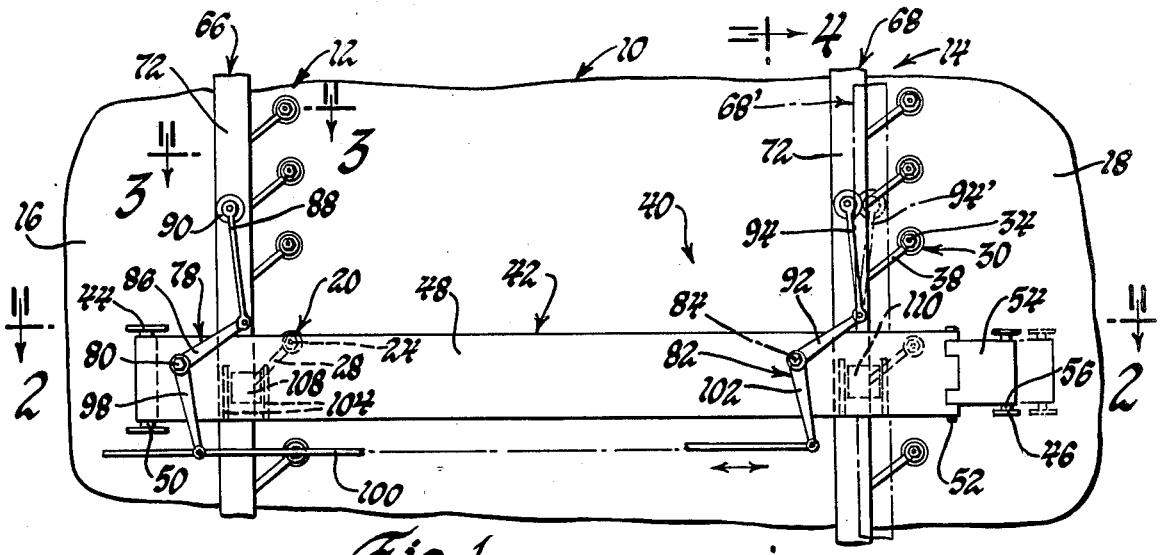
FIG. 1 is a fragmentary plan view of an improved vane actuation system according to this invention.

Referring now to FIG. 1 of the drawings, there shown is a segment, designated generally 10, of an annular outer casing of a gas turbine engine of the type having an axial flow compressor, the engine further including a first stage 12 of adjustable stator vanes and a second stage 14 of adjustable stator vanes. In the embodiment illustrated, the first stage 12 is representative of what could be a series of vane stages in a low pressure section of the compressor located at a forward or upstream portion 16 of the engine. Similarly, the second stage 14 is representative of what could be a series of stator vane stages in a high pressure section of the compressor located in a further aft or downstream portion 18 of the engine. In such arrangements the engine typically reaches higher temperatures along its length from front to back so that the fist stage 12 at the forward portion 16 of the engine operates in a lower temperature environment than the second stage 14 at the aft portion 18.

Figure 2:
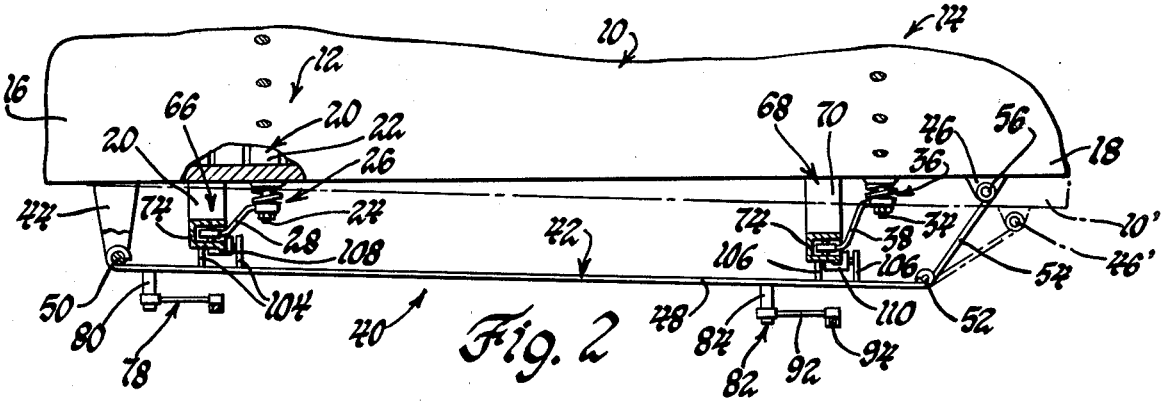
FIG. 2 is a partially broken away view taken generally along the plane indicated by lines 2—2 in FIG. 1.
Figure 3:
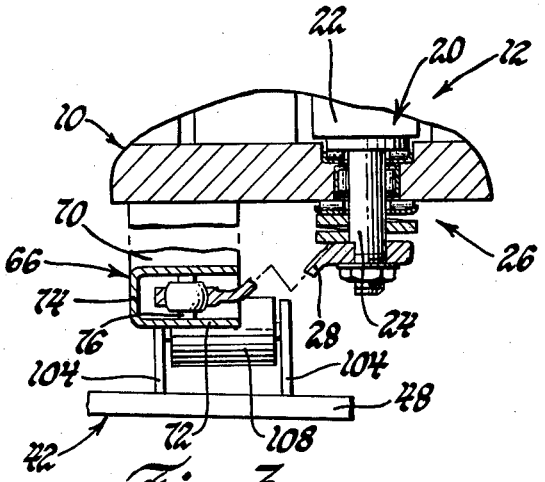
FIG. 3 is an enlarged view taken generally along the plane indicated by lines 3—3 in FIG. 1.

With particular reference now to FIGS. 2 and 3, the first stage 12 includes a plurality of adjustable stator vanes disposed around the circumference of the engine casing 10, only a single stator vane 20 being illustrated in FIGS. 2 and 3. The vane 20 has a main portion 22 disposed in the compressed air stream inside the casing 10 and a shaft portion 24 projecting outboard through the casing. The vane 20 is rotatably supported on the casing 10 by conventional thrust bearing means designated generally 26, the thrust bearing means shown being a representative one of any number of functionally identical arrangements and forming no part of this invention. Outboard of the casing 10 an actuating arm 28 is rigidly attached to the shaft portion 24 and functions to rotate the vane 20 for adjustment purposes. The second stage 14 includes a plurality of structurally similar stator vanes 30, FIG. 4, disposed around the circumference of the casing 10, each vane 30 including a main portion 32 located inboard of the casing 10 and a shaft portion 34 projecting outboard of the casing. Support means designated generally 36 rotatably support the vane 30 for adjustment by an actuator arm 38 rigidly attached to the shaft portin 34 outboard of the casing.

As seen best in FIGS. 1 and 2, an improved vane actuation system designated generally 40 is provided on the casing 10 for the purpose of effecting simultaneous adjustment of the vanes in first and second vane stages 12 and 14 and includes a support platform assembly 42. While only one platform assembly 42 is shown in the drawings, it will be apparent from the following description that one or more additional structurally and functionally identical platform assemblies are disposed around the circumference of the engine casing. The platform assembly 42 includes a first hinge support 44 rigidly attached to the casing 10 at the forward portion 16 and a second hinge support 46 rigidly attached to the casing 10 at the aft portion 18. A platform 48 has one end disposed on a pin 50 carried by the first hinge support 44 for pivotal movement about an axis defined by the pin. The opposite end of the platform 48 carries a pin 52 which rotatably supports one end of a compensating link 54, the other end of the link being supported on a pin 56 carried by the second hinge support 46 for pivotal movement about an axis defined by the pin 56. As described more fully hereinafter, the platform 48 and the compensating link 54 copperate with the engine casing 10 in defining a three-bar linkage which automatically adjusts for thermal growth occurring in the engine casing between the forward portion 16 and the aft portion 18.

Figure 4:
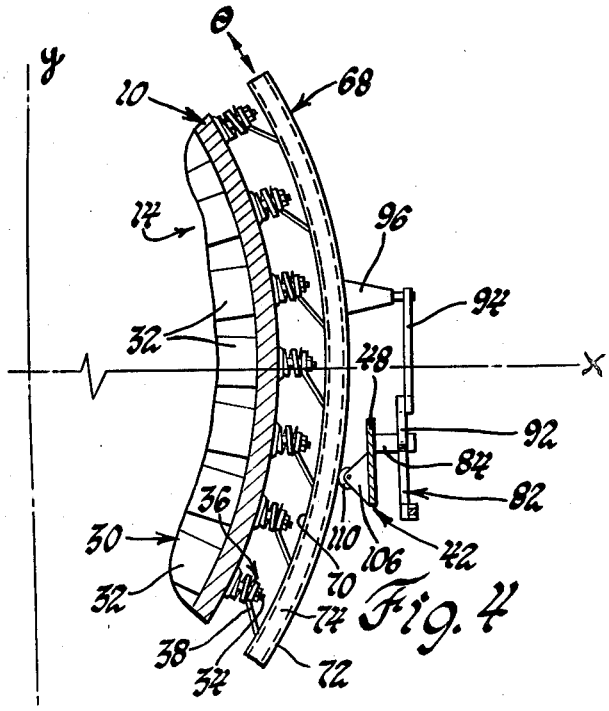
FIG. 4 is a fragmentary sectional view taken generally along the plane indicated by lines 4—4 in FIG. 1.

Referring now to FIGS. 1, 2 and 4, a forward actuator ring 66 is disposed around the engine casing 10 radially inboard of the platform 48 at the first vane stage 12 and an aft actuator ring 68 is similarly disposed around the engine casing adjacent the second vane stage 14. The forward and aft actuator rings are structurally similar and, as best seen in FIG. 3, each is generally channel shaped in cross section having an inner flange 70 and an outer flange 72 separated by a web 74. A plurality of trunnions or like devices designated 76, FIG. 3, corresponding in number to the number of individual stator vanes in the stages 12 and 14 are disposed between the inner and outer flanges 70 and 72 on each of the rings 66 and 68. Each trunnion 76 is connected to the distal end of a corresponding one of the actuator arms 28 in the first vane stage 12 and to a corresponding one of the actuator arms 38 in the second vane stage 14 by conventional bearing means, not shown, which function to restrict lateral motion of the ends of the actuator arms 28 and 38 while permitting relative radial movement along the trunnions 76 between the inner and outer flanges 70 and 72. To this end the depth of the web 74 is preselected to permit the desired amount of relative radial movement as described more fully hereinafter. The forward ring 66 thus functions in known manner to effect rotation of each of the shaft portions 24 through the actuator arms 28 in response to rotation of the actuator ring relative to the engine casing 10. Similarly, rotation of the aft actuator ring 68 effects adjusting rotation of each of the stator vanes 30 in the second stage 14 through the actuator arms 38 and the shaft portions 34.

As seen best in FIGS. 1 and 4, the improved actuation system 40 according to this invention further includes a forward bell crank 78 rotatably supported on a post 80 projecting from the platform 48 and an aft bell crank 82 rotatably supported on a post 84 similarly rigidly projecting from the platform 48. A first arm 86 of the forward bell crank is pivotally connected to a forward intermediate link 88 disposed generally in the plane of forward ring 66, the other end of which link is pivotally connected to an abutment 90 rigidly attached to the outer flange 72 of the forward ring 66. At the aft bell crank 82, a similar first arm 92 is pivotally connected to one end of an aft intermediate link 94 disposed generally in the plane of aft ring 68 the other end of which is pivotally connected to an abutment 96 rigidly attached to the outer flange 72 of the aft actuator ring 68. A second arm 98 of the forward bell crank 78 is pivotally connected to an operating rod 100 extending generally parallel to the longitudinal axis of the casing. A second arm 102 of the aft bell crank 82 is also pivotally connected to the operating rod 100 such that longitudinal or fore and aft reciprocation of the operating rod effects simultaneous pivotal movement of the forward and aft bell cranks 78 and 82. Simultaneous pivotal movement of the bell cranks, as described hereinafter, effects concurrent rotation of the forward actuator ring 66 and the aft actuator ring 68 through the forward and aft intermediate links 88 and 94, respectively, and, conversely, fixing rod 100 functions to rigidly maintain the positions of the actuator rings and the corresponding adjustment of the stator vanes.

With respect now to support of the forward and aft actuator rings on the engine casing and referring particularly to FIGS. 1 and 4, a reference coordinate system can be established and used to describe all possible movements of the actuator rings in their individual planes disposed perpendicular to the longitudinal axis of the engine casing. Specifically, with perpendicular X and Y axes, originating at the longitudinal axis of the engine casing, FIG. 4, any translational movement by the actuator rings can be described in terms of movement along the X and Y axes. Conversely, restraint of movement in the X and Y directions prevents any translational movement in any direction in the plane of the coordinate axes. The one other degree of freedom of moement of the rings in their respective planes is rotation about the longitudinal axis of the engine, represented by $\theta$ in FIG. 4. If, in combination with the previously described restraints in the X and Y directions the rings are prevented from rotating through any angle $\theta$, all possible movement of the rings in their respective planes is foreclosed or, stated differently, the rings are rigidly supported relative to the engine casing 10.

In the preferred embodiment shown, the platform 48 has a pair of spaced ears 104 rigidly projecting inward adjacent forward actuator ring 66 and a similar pair of spaced ears 106 projecting inward adjacent aft ring 68. A roller 108 is rotatably supported between the ears 104 and engages outer flange 72 of the ring 66. A roller 110 is likewise rotatably supported between ears 106 and engages the outer flange 72 of the aft ring 68. A second platform assembly, not shown, functionally and structurally identical to platform assembly 42 is disposed diametrically opposite assembly 42 and cooperates with the latter in supporting the forward and aft actuator rings on the engine casing. In particular, the roller 108 and the corresponding roller on the opposite side engate the forward ring 66 to foreclose any translation of the ring in the X direction. The roller 110 and the corresponding opposite roller likewise engage aft ring 68 to foreclose movement of that ring in the X direction. At the forward ring 66, the intermediate link 88, disposed substantially in the plane of the ring, is held rigid in the Y direction by first arm 86 of forward bell crank 78 and therefore forecloses translation of the ring in the Y direction. The intermediate link 94 between the first arm 92 of the aft bell crank and the aft ring 68 similarly forecloses translation of the aft ring in the Y direction. Both rings 66 and 68 are thus rigidly supported relative to the engine casing centered on the longitudinal axis of the latter. Of course, the intermediate links 88 and 94 also foreclose rotation of the forward and aft rings through any angles $\theta$ so long as the forward and aft bell cranks are held fixed by rod 100.

It will be apparent from the foregoing description that the rollers 108 and 110 can be eliminated if three or more platform assemblies are employed. In the case of three platform assemblies, for example, each would be angularly separated by 120° from the other assemblies so that the intermediate links corresponding to linnks 88 and 94 in platform assembly 42, in combination, would foreclose translation of the actuator rings in both the X and the Y directions. The same result occurs when more than three platform assemblies are employed as long as they are spaced around the circumference of the engine casing with intermediate links operative to restrict motion in both the X and the Y directions.

Describing now the operation of the improved actuation system according to this invention, whenever it is desired to effect adjustment of the first and second stator vane stages, force is applied to the operating rod 100 to rotate the bell cranks and shift the intermediate links 88 and 94 which effect rotation of the forward and aft actuator rings. The platform 48 is constructed to have substantial depth in the direction parallel to the plane containing the bell crank arms so that the platform has sufficient structural rigidity to withstand the loads applied during vane adjustment and engine operation. The rings 66 and 68, supported as described hereinbefore, are centered with respect to the longitudinal axis of the engine casing and rotate under the influence of driving force applied by the intermediate links 88 and 94 to effect vane adjustment. When the operating rod 100 is held fixed, the rings are likewise held stationary thereby to maintain the adjusted position of the vanes.

With reference now to thermal growth during engine operation, since the forward portion 16 of the engine operates at a different temperature than the aft portion 18, the casing 10 experiences uneven thermal expansion patterns such that there occurs at the aft portion 18 axial and radial growth relative to the forward portion 16. With respect to axial growth, the second stage 14 moves aft relative to the first stage 12 resulting in rearward displacement of the actuator ring 68 relative to the forward ring 66 to a position 68' shown in broken lines in FIG. 1. With respect to radial thermal growth the outer casing 10 tends to expand radially in the higher temperature operating region at the aft portion 18 as compared to the forward portion 16 so that the casing takes on a somewhat conical configuration represented in exaggerated fashion by broken line 10' in FIG. 2. Accordingly, the second hinge support 46 at the aft portion 18 assumes a displaced position 46' relative to first hinge support 44 at the forward portion 16. This combination of radial and axial thermal growth, unless otherwise provided for, will change the adjusted positions of the vanes in one or both vane stages 12 and 14.

In the improved actuation system 40 according to this invention, thermal growth is provided for as follows. With respect to radial expansion, the three-bar linkage defined by the platform 48, compensating link 54 and the casing 10 simply flexes at the pin 52 with little or no change in the orientation of the platform 48 relative to the casing 10. This same flexing also occurs at the opposite platform assembly, not shown, so that the net effect is to maintain the rings 66 and 68 centered about the engine. The actuating arms 28 and 38, however, will expand radially relative to the rings since they are carried on the engine casing. To accommodate radial relative movement between the arms 28 and 38 and the rings 66 and 68, respectively, a sliding fit is maintained between the ends of the arms and the trunnions 76 and the depth of webs 74 is made sufficiently large to provide room for expansion between the flanges 70 and 72. With respect to axial growth, the aft intermediate link 94 is sufficiently long and oriented substantially in the plane of the ring 68 so that no significant foreshortening of the distance between the first arm 92 and the abutment 96 occurs when the aft intermediate link pivots to a broken line position 94', FIG. 1, corresponding to the broken line position 68' of the ring 68. Accordingly, no significant rotation of the ring 68 occurs and the vanes in stage 14 are undisturbed. Finally, since the rings 66 and 68 and the platform assembly 42 are all spaced from the engine casing, they tend to operate in a lower, more uniform temperature environment so that no significant relative thermal growth is experienced between these components.

The embodiments of the invention in which an exclusive property or privilege is claimed are defined as follows:

1. In a gas turbine engine having an axial flow compressor including a first stage and a second stage of adjustable stator vanes disposed on a casing of said engine at axially spaced locations experiencing relative axial and radial thermal growth, an arm on each of said stator vanes for positioning each of said vanes relative to said casing, and a first actuating ring and a second actuating ring disposed around said casing at respective ones of said first and said second vane stages, an improved vane actuation system comprising, a plurality of elongated platform members each having a first end pivotally connected to said casing adjacent one of said vane stages, a plurality of compensating links each having a first end pivotally connected to said casing adjacent the other of said vane stages and a second end pivotally connected to a corresponding one of said platform members, said compensating links and said platform members cooperating with said casing in defining three-bar linkages operative to locate said platform members on said casing substantially independent of relative radial and axial thermal growth between said vane stages, connecting means between each of said arms and corresponding ones of said actuating rings operative to rigidly maintain said vanes in positions corresponding to the angular positions of said rings while permitting radial expansion of said arms relative to said actuating rings so that said rings are isolated from radial thermal growth of said casing, and ring support and drive means disposed between each of said platform assemblies and each of said actuating rings operative to maintain each of said actuating rings in centered relationship with respect to the longitudinal axis of said casing and to rotate each of said actuating rings about the longitudinal axis of said casing to effect adjustment of said stator vanes, said ring support and drive means being further operative to maintain the positions of each of said actuating rings substantially independently of relative axial thermal growth between said first and said second stator vane stages.

2. In a gas turbine engine having an axial flow compressor including a first stage and a second stage of adjustable stator vanes disposed on a casing of said engine at axially spaced locations experiencing ralative axial and radial thermal growth, an arm on each of said stator vanes for positioning each of said vanes relative to said casing, and a first actuating ring and a second actuating ring disposed around said casing at respective ones of said first and said second vane stages, an inproved vane actuation system comprising, a plurality of elongated platform members each having a first end pivotally connected to said casing adjacent one of said vane stages, a plurality of compensating links each having a first end pivotally connected to said casing adjacent the other of said vane stages and a second end pivotally connected to a corresponding one of said platform members, said compensating links and said platform members cooperating with said casing in defining three-bar linkages operative to locate said platform members on said casing substantially independent of relative radial and axial thermal growth between said vane stages, connecting means between each of said arms and corresponding ones of said actuating rings operative to rigidly maintain said vanes in positions corresponding to the angular positions of said rings while permitting radial expansion of said arms relative to said actuating rings so that said rings are isolated from radial thermal growth of said casing, a plurality of first intermediate links corresponding in number to the number of said platform members pivotally connected to and disposed generally in the plane of said first actuating ring, a plurality of second intermediate links corresponding in number to the number of said platform members pivotally connected to and disposed generally in the plane of said second actuating ring, drive means on each of said platform members pivotally connected to corresponding ones of said first and said second intermediate links operative to hold each of said intermediate links fixed thereby to foreclose rotation of each of said actuating rings about the longitudinal axis of said engine casing and to foreclose translation in the planes of said rings in at least one of two perpendicular coordinate directions, said drive means being further operative to bodily shift each of said intermediate links thereby to effect rotation of said actuating rings about the longitudinal axis of said engine casing, and means between each of said actuating rings and each of said platform members operative to foreclose translation of each of said rings in the other of said two perpendicular coordinate directions so that each of said actuating rings is supported on said engine casing in centered relationship with respect to the longitudinal axis of said engine casing.

3. In a gas turbine engine having an axial flow compressor including a first stage and a second stage of adjustable stator vanes disposed on a casing of said engine at axially spaced locations experiencing relative axial and radial thermal growth, an arm on each of said stator vanes for positioning each of said vanes relative to said casing, and a first actuating ring and a second actuating ring disposed around said casing at respective ones of said first and said second vane stages, an improved vane actuation system comprising, a pair of elongated platform members each having a first end pivotally connected to said casing adjacent one of said vane stages, a pair of compensating links each having a first end pivotally connected to said casing adjacent the other of said vane stages and a second end pivotally connected to a corresponding one of said platform members, said compensating links and said platform members cooperating with said casing in defining three-bar linkages operative to locate said platform members on said casing substantially independent of relative radial and axial thermal growth between said vane stages, connecting means between each of said arms and corresponding ones of said actuating rings operative to rigidly maintain said vanes in positions corresponding to the angular positions of said rings while permitting radial expansion of said arms relative to said actuating rings so that said rings are isolated from radial thermal growth of said casing, a pair of first intermediate links pivotally connected to and disposed generally in the plane of said first actuating ring, a pair of second intermediate links pivotally connected to and disposed generally in the plane of said second actuating ring, a pair of first bell cranks pivotally supported on respective ones of said pairs of platform members each having one arm pivotally connected to a corresponding one of said first intermediate links and another arm connected to a drive member, a pair of second bell cranks pivotally supported on respective ones of said pair of platform members each having one arm pivotally connected to a corresponding one of said second intermediate links and another arm connected to said drive member, said drive member being operative to hold each of said bell cranks and each of said intermediate links fixed thereby to foreclose rotation of each of said actuating rings about the longitudinal axis of said engine casing and to foreclose translation in the planes of said rings in one of two perpendicular coordinate directions, said drive member being further operative to rotate each of said bell cranks to bodily shift each of said intermediate links thereby to effect rotation of said actuating rings about the longitudinal axis of said engine casing, and a pair of rollers pivotally supported on each of said platform members engaging each of said first and said second actuating rings operative to foreclose translation of each of said actuating rings in the other of said two perpendicular coordinate directions while permitting rotation of each of said actuating rings about the longitudinal axis of said engine casing, each of said first and second intermediate links and said rollers cooperating in supporting each of said first and said second actuating rings on said engine casing in centered relationship with respect to the longitudinal axis of said engine casing.

* * * * *